US011933320B2

(12) United States Patent
Brewer et al.

(10) Patent No.: US 11,933,320 B2
(45) Date of Patent: Mar. 19, 2024

(54) PUMP DAMPER ASSEMBLY AND DISHWASHER APPLIANCE

(71) Applicant: Haier US Appliance Solutions, Inc., Wilmington, DE (US)

(72) Inventors: Kyle Brewer, Louisville, KY (US); Mark Fryman, Louisville, KY (US); Craig Curtis, Crestwood, KY (US); Steven Koepke, La Grange, KY (US); Luke Fredette, London, OH (US); Scott Noll, Blacklick, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 238 days.

(21) Appl. No.: 17/075,887

(22) Filed: Oct. 21, 2020

(65) Prior Publication Data

US 2022/0120292 A1 Apr. 21, 2022

(51) Int. Cl.

| | |
|---|---|
| ***A47L 15/42*** | (2006.01) |
| ***F04D 13/06*** | (2006.01) |
| ***F04D 29/66*** | (2006.01) |

(52) U.S. Cl.

CPC ..... *F04D 29/669* (2013.01); *A47L 15/4209* (2016.11); *A47L 15/4225* (2013.01); *F04D 13/06* (2013.01)

(58) Field of Classification Search

CPC ..... A47L 15/4225; A47L 15/4209; F04D 29/669; F04D 13/16

See application file for complete search history.

(56) References Cited

U.S. PATENT DOCUMENTS

| | | | | |
|---|---|---|---|---|
| 1,855,570 | A * | 4/1932 | Edison | F16F 7/10 123/192.1 |
| 3,026,815 | A * | 3/1962 | Jacobs | F04D 29/605 285/137.11 |
| 5,637,938 | A | 6/1997 | Debrecht | |
| 9,211,048 | B2 | 12/2015 | Bennett | |
| 2006/0000240 | A1* | 1/2006 | Song | D06F 39/085 68/3 R |
| 2011/0120509 | A1* | 5/2011 | Busing | D06F 37/20 134/112 |
| 2012/0048314 | A1* | 3/2012 | Vitan | B08B 3/02 134/56 R |
| 2016/0327048 | A1* | 11/2016 | Xu | A47L 15/4225 |

FOREIGN PATENT DOCUMENTS

| | | | | |
|---|---|---|---|---|
| DE | 19927896 | A1 * | 4/2000 | A47L 15/4225 |
| FR | 2505642 | A3 * | 11/1982 | A47L 15/42 |
| WO | WO2011064348 | A1 | 6/2011 | |

* cited by examiner

*Primary Examiner* — Joseph L. Perrin
*Assistant Examiner* — Irina Graf
(74) *Attorney, Agent, or Firm* — Dority & Manning, P.A.

(57) ABSTRACT

A dishwasher appliance or pump assembly may include a fluid pump and a vibration damper. The fluid pump may define a center of gravity. The vibration damper may be attached to the fluid pump. The vibration damper may include first and second spring beams and first and second damper masses. The first spring beam may extend longitudinally between a fixed end and a free end and be offset from the center of gravity at a first radial side. The first damper mass may be disposed on the free end of the first spring beam. The second spring beam may extend longitudinally between a fixed and a free end and be offset from the center of gravity at a second radial side. The second damper mass may be disposed on the free end of the second spring beam.

19 Claims, 10 Drawing Sheets

PUMP DAMPER ASSEMBLY AND DISHWASHER APPLIANCE

FIELD OF THE INVENTION

The present subject matter relates generally to assemblies for absorbing vibrations generated at a pump of a domestic appliance, such as a dishwashing appliance.

BACKGROUND OF THE INVENTION

Pumps using electric motors (i.e., electric pump) are common for many domestic appliances, such as dishwashing appliances and washing machine appliances. Such appliances may, for instance, use one or more pumps having an impeller rotated by an electric motor to cycle fluid through a tub.

One of the concerns that can arise with electric pumps is the generation of vibrations. While the pump is running, vibrations may be transmitted through the motor in one or more directions (e.g., along distinct axes) and to the surrounding support structure. The transmitted vibrations, in turn, may risk damaging the support structure or generate vibrational noise. The vibrational noise is generally undesirable, and may be especially problematic if the pump is part of a domestic appliance or otherwise intended for a quiet environment. Therefore, it is desirable to reduce the transmission of electric pump vibration.

Some existing appliances use elastic or suspended mounting configurations to absorb or isolate vibrations from an electric pump. Some appliances add supplemental weights or mass elements to reduce vibrations. Various other systems use active control methods (e.g., active vibration controls, variable motor speeds, etc.) to mitigate the vibrations transmitted to the rest of the appliance.

Active vibration cancellation systems are complex and expensive. Other methods, such as with known spring-mass systems, can be less expensive. Nonetheless, existing systems can be inadequate for sufficiently reducing vibrations transmitted from a motor. In both cases, it can be difficult to tune an assembly to account for vibrations in more than one direction.

As a result it would be advantageous to provide a reliable, inexpensive, or efficient assembly for reducing vibrations transferred from an electric pump. In particular, it would be useful for such a system to reduce vibrations in multiple directions.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a pump assembly for a domestic appliance is provided. The pump assembly may include a fluid pump and a vibration damper. The fluid pump may define a center of gravity. The fluid pump may include a pump housing and a motor mounted to the pump housing. The vibration damper may be attached to the fluid pump to absorb vibrations thereof. The vibration damper may include a first spring beam, a first damper mass, a second spring beam, and a second damper mass. The first spring beam may extend longitudinally between a fixed end proximal to the pump housing and a free end distal to the pump housing. The free end of the first spring beam may be offset from the center of gravity at a first radial side. The first damper mass may be disposed on the free end of the first spring beam at the first radial side. The second spring beam may extend longitudinally between a fixed end proximal to the pump housing and a free end distal to the pump housing. The free end of the second spring beam may be offset from the center of gravity at a second radial side. The second damper mass may be disposed on the free end of the second spring beam at the second radial side.

In another exemplary aspect of the present disclosure, a dishwashing appliance is provided. The dishwashing appliance may include a tub, a sump, a pump housing, a motor, and a vibration damper. The tub may define a wash chamber for receipt of articles for washing. The sump may be positioned at a bottom portion of the tub along a vertical direction. The pump housing may be mounted to the sump. The motor may be mounted to the pump housing below the sump. The vibration damper may be attached to the pump housing to absorb vibrations thereon. The vibration damper may include a first spring beam, a first damper mass, a second spring beam, and a second damper mass. The first spring beam may extend longitudinally between a fixed end proximal to the pump housing and a free end distal to the pump housing. The free end of the first spring beam may be offset from the center of gravity at a first radial side. The first damper mass may be disposed on the free end of the first spring beam at the first radial side. The second spring beam may extend longitudinally between a fixed end proximal to the pump housing and a free end distal to the pump housing. The free end of the second spring beam may be offset from the center of gravity at a second radial side. The second damper mass may be disposed on the free end of the second spring beam at the second radial side These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
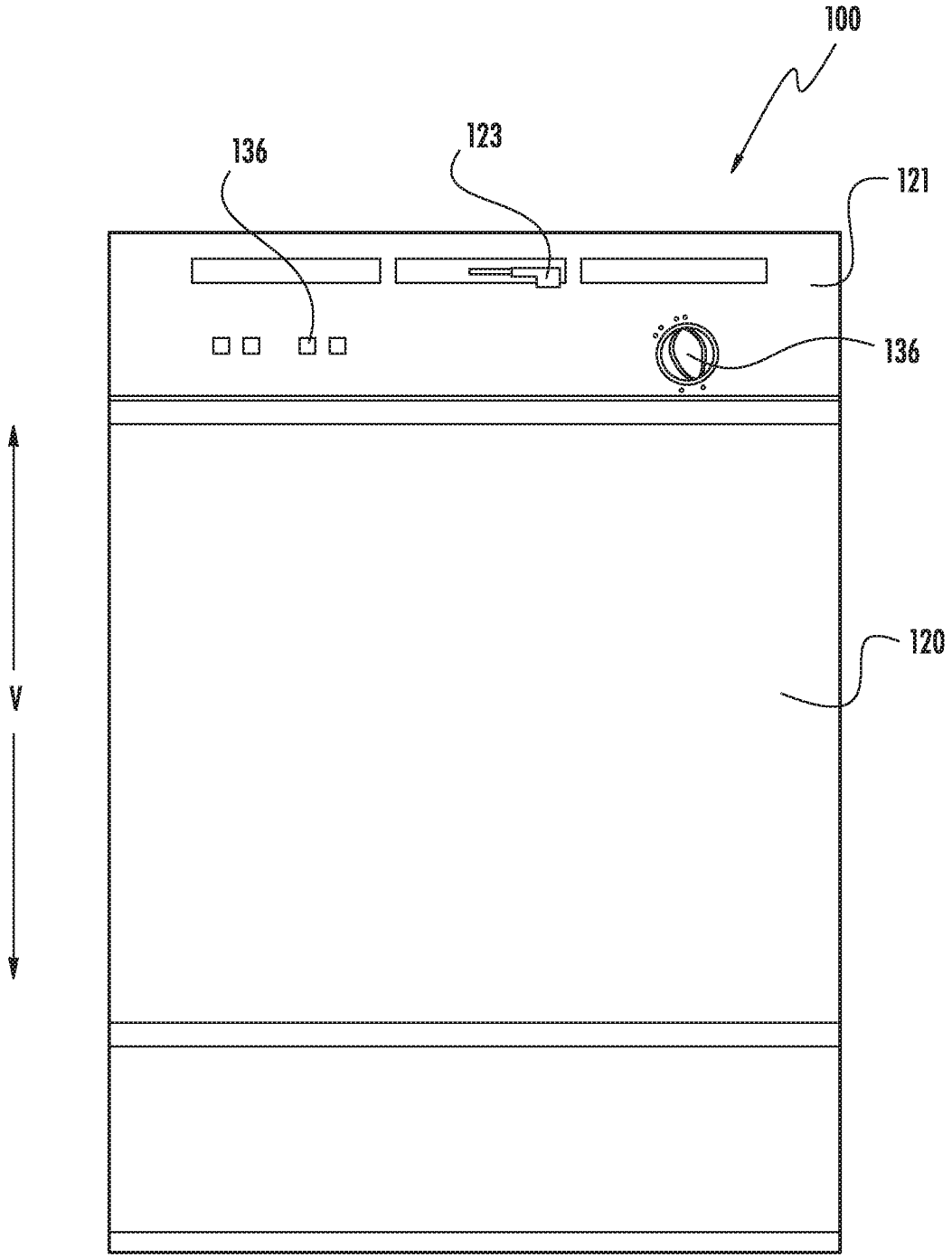
FIG. 1 provides an elevation view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
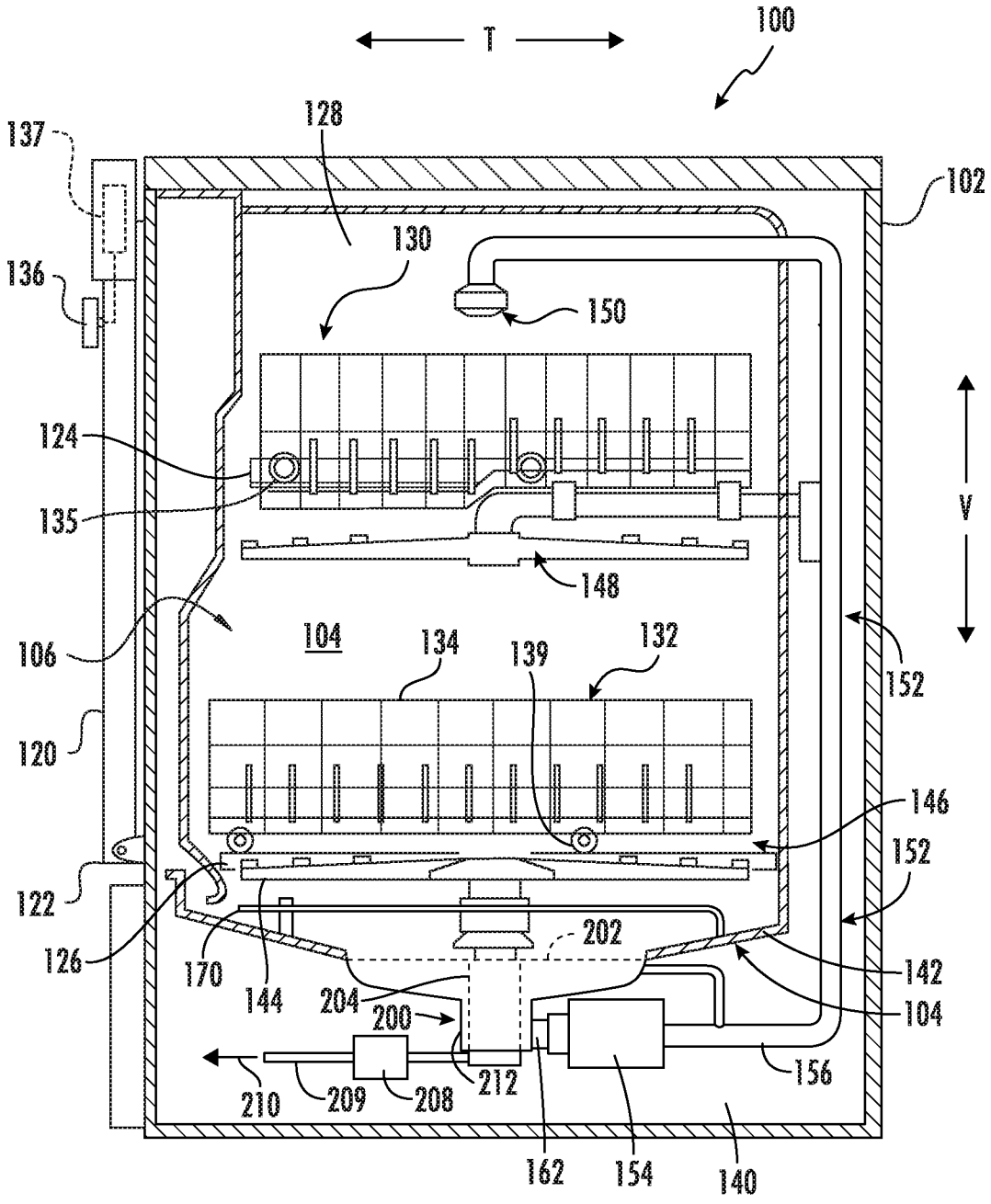
FIG. 2 provides a side section view of the exemplary dishwasher appliance of FIG. 1.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 defining a vertical direction V and having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher. Latch 123 is used to lock and unlock door 120 for access to wash chamber 106.

Upper and lower guide rails 124, 126 are mounted on tub side walls 128 and accommodate roller-equipped rack assemblies 130 and 132. In optional embodiments, each of the rack assemblies 130, 132 is fabricated into lattice structures including a plurality of elongated members 134 (for clarity of illustration, not all elongated members forming assemblies 130 and 132 are shown in FIG. 2). Each rack 130, 132 is adapted for movement (e.g., along a transverse direction T) between an extended loading position (not shown), in which the rack is substantially positioned outside the wash chamber 106, and a retracted position (shown in FIGS. 1 and 2), in which the rack is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like that are otherwise too small to be accommodated by the racks 130, 132.

The dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. In exemplary embodiments, such as the embodiment of FIGS. 1 and 2, one or more elevated spray assemblies 148, 150 are provided above the lower spray-arm assembly 144. For instance, a mid-level spray-arm assembly 148 is located in an upper region of the wash chamber 106 and may be located in close proximity to upper rack 130. Additionally or alternatively, an upper spray assembly 150 may be located above the upper rack 130.

The lower and mid-level spray-arm assemblies 144, 148 and the upper spray assembly 150 are part of a fluid circulation assembly 152 for circulating a wash fluid, such as water or dishwasher fluid, in the tub 104. In turn, fluid circulation assembly 152 may provide a flow of wash fluid within the wash chamber 106. For instance, fluid circulation assembly 152 includes a water inlet hose 172 in fluid communication with the wash chamber 106 (e.g., through bottom wall or sidewall of tub 104) to supply water thereto, as generally recognized in the art. The sump portion 142 may thus be filled with water through a fill port 175 that outlets into wash chamber 106. A water supply valve 174 may be provided to control water to the wash chamber 106. Water supply valve 174 may have a hot water inlet 176 that receives hot water from an external source, such as a hot water heater and a cold water input 178 that receives cold water from an external source. It should be understood that the term "water supply" is used herein to encompass any manner or combination of valves, lines or tubing, housing, and the like, and may simply comprise a conventional hot or cold water connection.

The fluid circulation assembly 152 also includes a circulation pump 154 positioned in a machinery compartment 140 located below the tub sump portion 142 (i.e., below a bottom wall) of the tub 104, as generally recognized in the art. The circulation pump 154 receives fluid from sump 142 to provide a flow to assembly 152, or optionally, a switching valve or diverter (not shown) may be used to select flow. A heating element 170 can be used to provide heat during, for example, a drying cycle or wash cycle.

Each spray-arm assembly 144, 148 includes an arrangement of discharge ports or orifices for directing washing fluid received from the circulation pump 154 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of the spray assembly 150 using fluid from the circulation pump 154 provides coverage of dishes and other dishwasher contents with a washing spray. Other configurations of spray assemblies may be used as well.

In some embodiments, the dishwasher appliance 100 is further equipped with a controller 137 to regulate operation of the dishwasher appliance 100. The controller 137 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. For certain embodiments, the instructions include a software package configured to operate appliance 100. The memory may be a separate component from the processor or may be included onboard within the processor. Alternatively, controller 137 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

The controller 137 may be positioned in a variety of locations throughout dishwasher appliance 100. In the illustrated embodiment, the controller 137 may be located within a control panel area 121 of door 120 as shown in FIGS. 1 and 2. In some such embodiments, input/output ("I/O") signals may be routed between the control system and various operational components of dishwasher appliance 100 along one or more wiring harnesses that may be routed through the bottom 122 of door 120. Optionally, the controller 137 includes a user interface panel/controls 136 through which a user may select various operational features and modes and monitor progress of the dishwasher appliance 100. In exemplary embodiments, the user interface 136 may represent a general purpose I/O ("GPIO") device or functional block. For instance, the user interface 136 may include input components, such as one or more of a variety of electrical, mechanical, or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

In optional embodiments, a filtering system 200 is provided. For instance, filtering system 200 may be located in the sump portion 142 and provides filtered fluid to the pump inlet 162. Generally, filtering system 200 removes soiled particles from the fluid that is recirculated through the wash chamber 106 during operation of dishwasher appliance 100. In exemplary embodiments, filtering system 200 includes one or both of a first filter 202 (also referred to as a "coarse filter") and a second filter 204 (also referred to as a "fine filter").

In some embodiments, the first filter 202 is constructed as a grate having openings (e.g., in the range of about 0.030 inches to about 0.060 inches) for filtering fluid received from wash chamber 106. The sump portion 142 includes a recessed portion over which the first filter 202 is removably received. Optionally, pump inlet may be defined within recessed portion. A recirculation conduit 156 may be disposed in fluid communication with the pump inlet 162 and the circulation pump 154. During certain operations, wash fluid may selectively flow through pump inlet 162 and recirculation conduit 156 before being motivated (e.g., by the circulation pump 154) to one or more of lower spray arm assembly 144, mid-level spray-arm assembly 148, or upper spray assembly 150.

The second filter 204 may be non-removable or can be provided as a removable cartridge positioned in a tub receptacle 212 formed in sump portion 142. For instance, the second filter 204 may be removably positioned within a collection chamber defined by a tub receptacle 212. The second filter 204 may be generally shaped to complement tub receptacle 212. For instance, the second filter 204 may include a filter wall (e.g., screen or mesh, having pore or hole sizes in the range of about 50 microns to about 600 microns) that complements a generally cylindrical shape of tub receptacle 212. Alternatively, tub receptacle 212 may have a suitable non-cylindrical shape to receive the second filter 204 and direct fluid to the drain outlet 210 through the filter wall.

Optionally, a drain pump 208 may be provided downstream from sump 142 (e.g., in fluid communication with a portion of second filter 214). Moreover, an exit conduit 209 may be positioned downstream from drain pump 208. As illustrated, exit conduit 209 may extend to a drain outlet 210. When drain pump 208 is activated, fluid or particles flowed to the sump 142 from the wash chamber 106 internal chamber 224 may thus be directed through exit conduit 209 and drain outlet 210, flowing wash fluid to an area outside of appliance 100 (e.g., an ambient area).

It should be appreciated that the invention is not limited to any particular style, model, or configuration of dishwasher. The exemplary embodiment depicted in FIGS. 1 and 2 is for illustrative purposes only. Other suitable domestic appliances having one or more pump assembly may be provided in accordance with the present disclosure.

Figure 3:
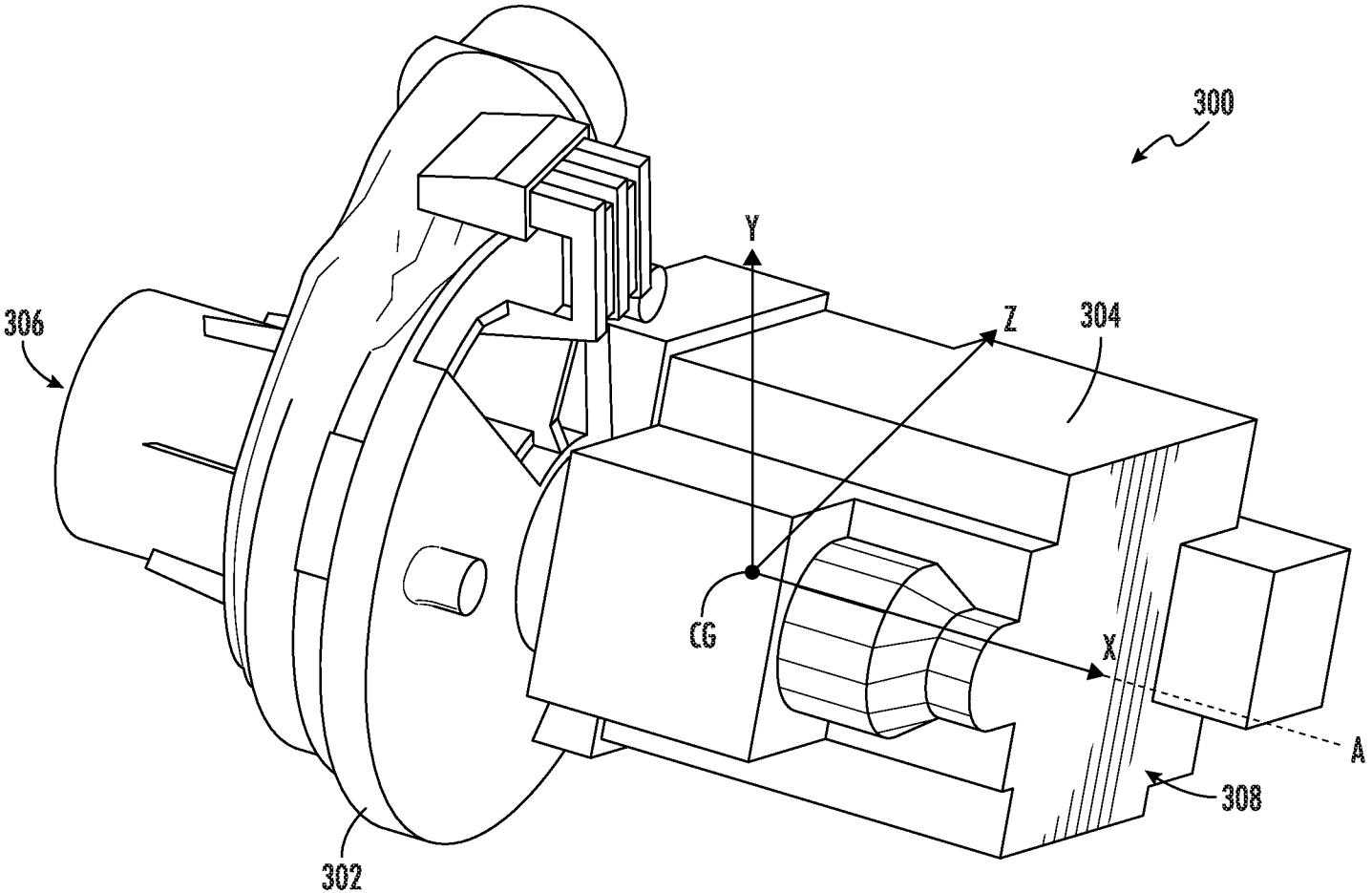
FIG. 3 provides a perspective view of a pump housing and motor according to exemplary embodiments of the present disclosure.

Turning now to FIG. 3, an exemplary fluid pump 300 is illustrated in isolation. Generally, it is understood that fluid pump 300 may be provided in any suitable domestic appliance, such as for or in place of circulation pump 154. As shown, fluid pump 300 includes a pump housing 302. A displacement body (e.g., impeller, piston, rotor, lobe, screw, gear, etc.) may be enclosed within pump housing 302 (e.g., to motivate fluid from the sump 142 to recirculation conduit 156). Moreover, a pump motor 304 (e.g., electric pump motor 304) may be attached to pump housing 302 in mechanical communication with the displacement body to direct movement thereof, as would be understood. In some embodiments, pump motor 304 is a synchronous motor and, thus, synchronizes rotation (e.g., of the rotating body or shaft thereto) with a frequency of a supply current, as is understood.

When assembled, fluid pump 300 generally defines an orthogonal direction system along three mutually-perpendicular directions or axes. For instance, a pair of horizontal axes, such as an X-axis and a Z-axis may be defined. In some such embodiments, the X-axis is parallel or coaxial with a rotation axis A of the pump motor 304 (e.g., about which the displacement body rotates), as shown. A vertical axis, such as a Y-axis may further be defined. Generally, each axis may intersect at a center of gravity CG defined by fluid pump 300 (e.g., in isolation or prior to attachment to appliance 100 or sump 142).

As shown, fluid pump 300 generally extends along the X-axis or rotation axis A. In certain embodiments, fluid pump 300 extends along such axis or axes between an anchored end 306 and an unmoored end 308. In an assembled state of appliance 100, anchored end 306 may be connected to or in supported contact with another portion of appliance 100, such as a mounting region or conduit connection of sump 142. For instance, pump inlet 162 may be defined at anchored end 306 and join fluid pump 300 to sump 142. In contrast to anchored end 306, unmoored end 308 may be unsupported or otherwise free of an additional connection to a surrounding portion of appliance 100. Thus, unmoored end 308 may generally be understood to be more susceptible to vertical displacement (e.g., relative to sump) than anchored end 306.

Figure 4:
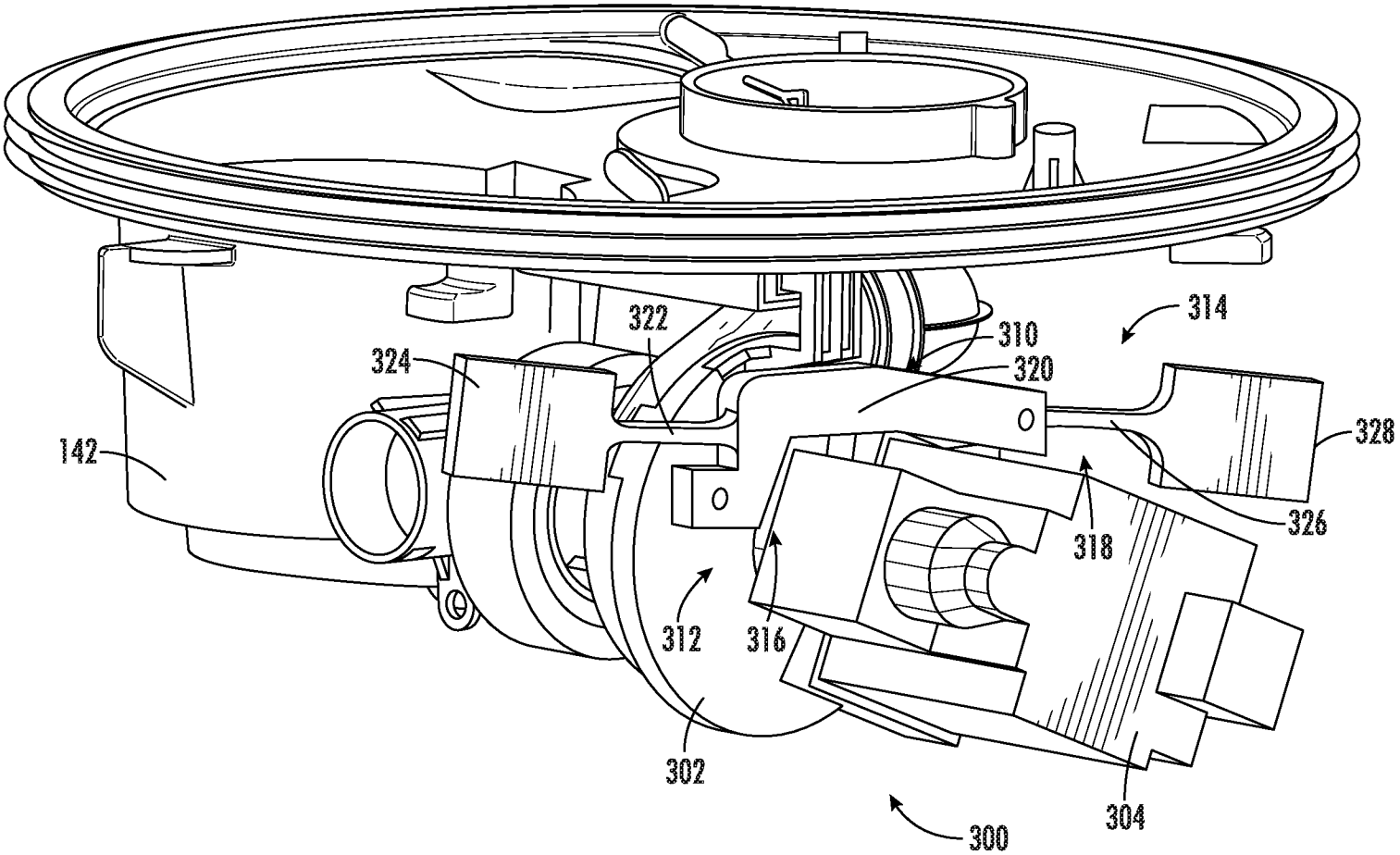
FIG. 4 provides a perspective view of a sump and pump assembly of a dishwashing appliance according to exemplary embodiments of the present disclosure.
Figure 5:
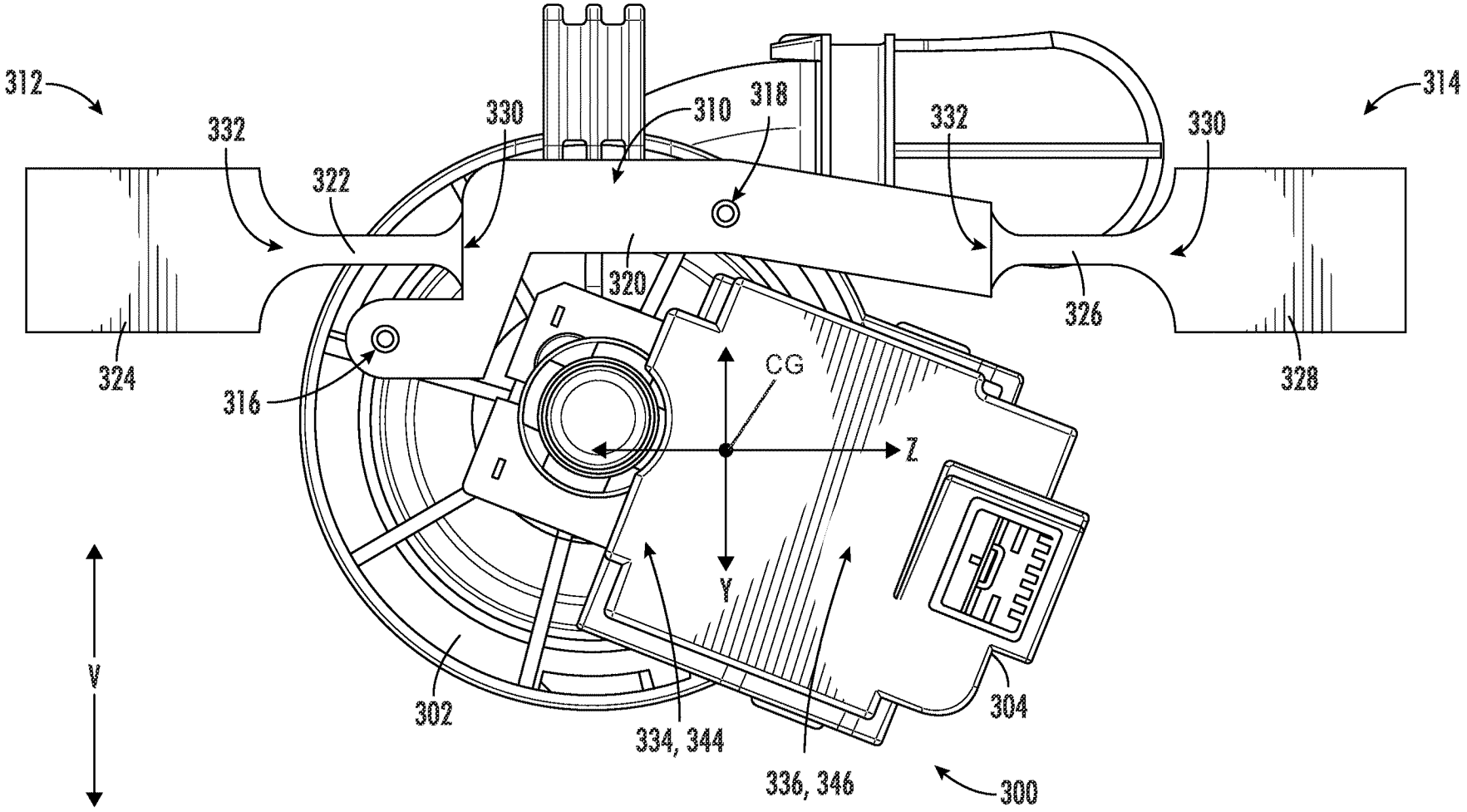
FIG. 5 provides an elevation view of the exemplary pump of FIG. 3.
Figure 6:
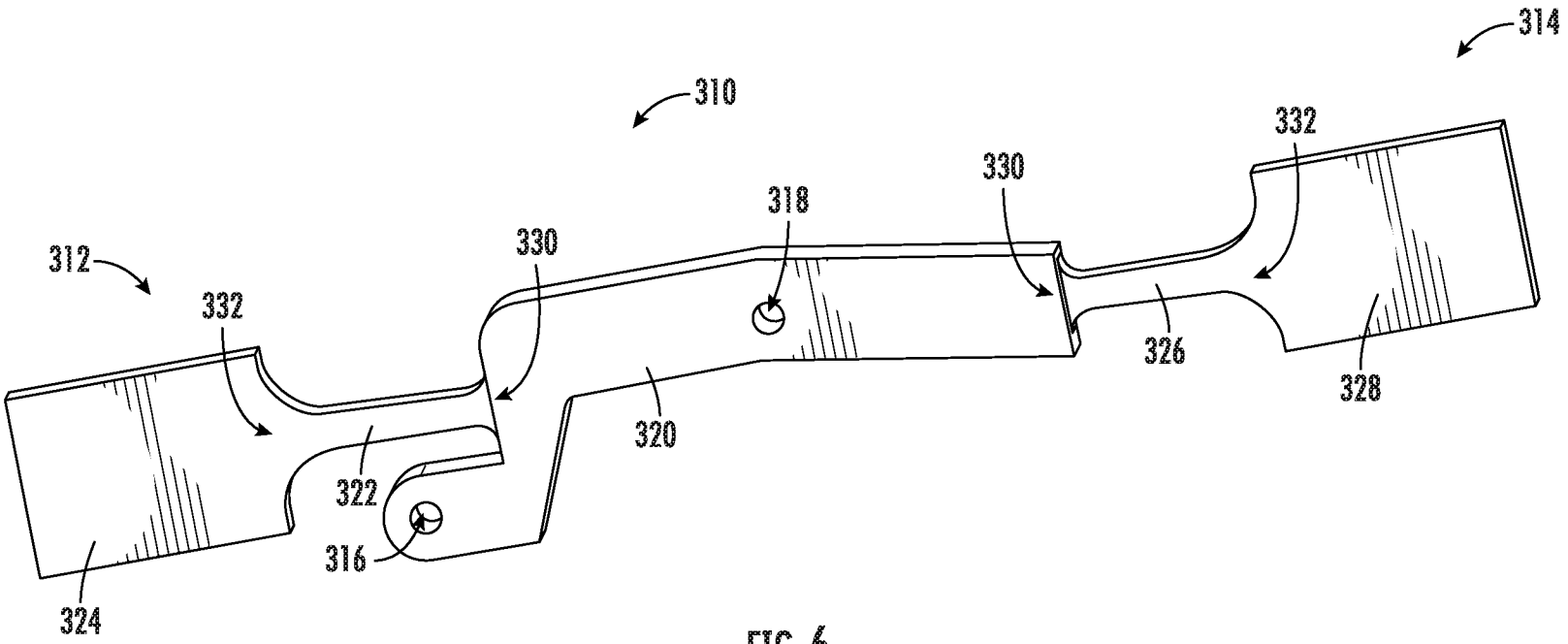
FIG. 6 provides a perspective view of the exemplary vibration damper of FIG. 3.

Turning especially to FIGS. 4 through 6, various views are provided illustrating an exemplary vibration damper 310. Generally, vibration damper 310 may be attached to fluid pump 300 to absorb vibrations thereof (e.g., along or about the Y-axis, X-axis, or Z-axis). Specifically, vibration damper 310 includes a pair of tuned damper bodies 312, 314 (i.e., a first damper body 312 and second damper body 314) that can be fixed to pump housing 302 at one or more attachment points 316, 318 (e.g., via a suitable adhesive or mechanical fastener, such as a screw, bolt, clip, mated thread, rivet, etc.).

In some embodiments, such attachment points 316, 318 are generally defined by one or more mounting brackets 320. As an example, discrete mounting brackets 320 may be provided for (and correspond to) each discrete damper body 312, 314 (e.g., each mounting bracket 320 having one or more corresponding attachment points 316, 318). As another example, and as shown, a single mounting bracket 320 may be provided for both damper bodies 312, 314. In the illustrated embodiments, two discrete attachment points 316, 318 are defined at discrete longitudinal locations. Thus, the two discrete attachment points 316, 318 are longitudinally spaced apart (e.g., relative to the Z-axis). Optionally, one attachment point 318 may be vertically aligned with the center of gravity CG (e.g., the one attachment point 318 and the center of gravity CG may be located along the Y-axis of an X-Y plane). Additionally or alternatively, a separate attachment point 316 may be horizontally spaced apart from (e.g., offset) from the center of gravity CG. Further additionally or alternatively, the one attachment point 318 may be disposed at a height that is higher than the height of the separate attachment point 316. In certain embodiments, it is notable that only two attachment points 316, 318 are provided, thereby generally reducing assembly costs and difficulties.

As shown, each damper body 312, 314 includes a corresponding spring beam 322, 326 and damper mass 324, 328 mounted on the spring beam 322, 326. Thus, first damper body 312 includes a first spring beam 322 and a first damper mass 324; second damper body 314 includes a second spring beam 326 and a second damper mass 328. Generally, and as will be described in greater detail below, each damper mass 324, 328 may be permitted to oscillate or move with respect to pump housing 302 as the pump motor 304 drives rotation and the corresponding spring beam 322, 326 deforms.

In the illustrated embodiments, first spring beam 322 extends longitudinally between a fixed end 330 and a free end 332. When assembled, the fixed end 330 of first spring beam 322 is generally close (i.e., proximal) to the pump housing 302. For instance, the fixed end 330 of first spring beam 322 may be joined (e.g., fixedly joined or, alternatively, separably joined) to mounting bracket 320. The fixed end 330 may thus be defined at or adjacent to (e.g., in comparison to the free end 332) mounting bracket 320 or a first attachment point 316. In some such embodiments, first spring beam 322 is integral to (e.g., formed as a monolithic unitary member with) mounting bracket 320. Nonetheless, alternative embodiments may provide a set of mated threads between first spring beam 322 and mounting bracket 320. Thus, first spring beam 322 may be threaded for mounting relative to mounting bracket 320.

In contrast to the fixed end 330, the free end 332 of first spring beam 322 is relatively far from (i.e., distal to) the pump housing 302. In certain embodiments, the free end 332 may be offset (e.g., spaced apart) from the center of gravity CG at a first radial side 334 thereof. Thus, the free end 332 of first spring beam 322 may held on one radial side 334 of the center of gravity CG. As an example, a vertical axis (e.g., Y-axis) extending from the center of gravity CG may separate two horizontal sides 344, 346 such that the free end 332 of first spring beam 322 is maintained on the first horizontal side 344. In some embodiments, the extension of first spring beam 322 (e.g., from the fixed end 330 to the free end 332) lies on path or axis that is perpendicular to the rotation axis A or X-axis, as shown. Optionally, the extension may be horizontal (e.g., perpendicular to the Y-axis or vertical direction V, such as parallel to the Z-axis).

As shown, the first damper mass 324 is disposed on the free end 332 of first spring beam 322. Thus, first damper mass 324 may be held on the first radial side 334. In some embodiments, first damper mass 324 is stiffer than the first spring beam 322. Specifically, first damper mass 324 may define a higher stiffness value relative to the Y-axis, Z-axis, or X-axis (e.g., one or all of the three axes) than first spring beam 322. Elastic deformation of first damper body 312 (e.g., during activation of pump motor 304) may, in turn, be concentrated at first spring beam 322, which may act as a deformable cantilever. Optionally, first damper body 312 defines a larger cross-sectional area (e.g., perpendicular to a longitudinal direction) than first spring beam 322, as shown. In some such embodiments, first damper mass 324 is integral to (e.g., formed as a monolithic unitary member with) first spring beam 322. Nonetheless, alternative embodiments may provide a set of mated threads between first spring beam 322 and first damper mass 324. Thus, first damper mass 324 may be threaded for mounting relative to first spring beam 322. Moreover, although first damper mass 324 is illustrated as a rectangular prism, any suitable shape (e.g., cylinder, disk, sphere, etc.) may be provided, such as a shape that is longitudinally symmetrical.

In the illustrated embodiments, second spring beam 326 extends longitudinally between a fixed end 330 and a free end 332. When assembled, the fixed end 330 of second spring beam 326 is generally close (i.e., proximal) to the pump housing 302. For instance, the fixed end 330 of second spring beam 326 may be joined (e.g., fixedly joined or, alternatively, separably joined) to mounting bracket 320. The fixed end 330 may thus be defined at or adjacent to (e.g., in comparison to the free end 332) mounting bracket 320 or a second attachment point 318. In some such embodiments, second spring beam 326 is integral to (e.g., formed as a monolithic unitary member with) mounting bracket 320. Nonetheless, alternative embodiments may provide a set of mated threads between second spring beam 326 and mounting bracket 320. Thus, second spring beam 326 may be threaded for mounting relative to mounting bracket 320.

In contrast to the fixed end 330, the free end 332 of second spring beam 326 is relatively far from (i.e., distal to) the pump housing 302. In certain embodiments, the free end 332 may be offset (e.g., spaced apart) from the center of gravity CG at a second radial side 336 thereof. Thus, the free end 332 of second spring may held on one radial side 336 of the center of gravity CG (e.g., opposite radial side 334). As an example, a vertical axis (e.g., Y-axis) extending from the center of gravity CG may separate two horizontal sides 344, 346 such that the free end 332 of second spring beam 326 is maintained on the second horizontal side 346 (e.g., opposite the first horizontal side 344). In some embodiments, the extension of second spring beam 326 (e.g., from the fixed end 330 to the free end 332) lies on path or axis that is perpendicular to the rotation axis A or X-axis. Optionally, the extension may be horizontal (e.g., perpendicular to the Y-axis or vertical direction, such as parallel to the Z-axis).

As shown, the second damper mass 328 is disposed on the free end 332 of second spring beam 326. Thus, second damper mass 328 may be held on the second radial side 336. In some embodiments, second damper mass 328 is stiffer than the second spring beam 326. Specifically, second damper mass 328 may define a higher stiffness value relative to the Y-axis, Z-axis, or X-axis (e.g., one or all of the three axes) than second spring beam 326. Elastic deformation of second damper body 314 (e.g., during activation of pump motor 304) may, in turn, be concentrated at second spring beam 326, which may act as a deformable cantilever.

Optionally, second damper body 314 defines a larger cross-sectional area (e.g., perpendicular to a longitudinal direction) than second spring beam 326, as shown. In some such embodiments, second damper mass 328 is integral to (e.g., formed as a monolithic unitary member with) second spring beam 326. Nonetheless, alternative embodiments may provide a set of mated threads between second spring beam 326 and second damper mass 328. Thus, second damper mass 328 may be threaded for mounting relative to second spring beam 326. Moreover, although second damper mass 328 is illustrated as a rectangular prism, any suitable shape (e.g., cylinder, disk, sphere, etc.) may be provided, such as a shape that is longitudinally symmetrical.

Relative to the fluid pump 300, the first and second damper bodies 312, 314 may be symmetrically tuned to notably counteract the translational or rotational forces generated during activation of pump motor 304 (e.g., to notably counteract motion coupling that might otherwise occur with a single damper body). For instance, first and second spring beams 322, 326, including the first and second spring beams 322, 326 and first and second damper masses 324, 328, may be symmetrically tuned (e.g., to have equivalent natural frequencies or vibrational modes to cancel or counteract the other) at opposite sides of the center of gravity CG. Optionally, first and second damper bodies 312, 314 may be formed integrally (i.e., as an integral unitary member), such as with mounting bracket 320.

In the illustrated embodiments of FIGS. 3 through 6, the first spring beam 322 and first damper mass 324 as well as the second spring beam 326 and the second damper mass 328 extend perpendicular to the rotation axis A. Moreover, the first spring beam 322 and first damper mass 324 extend along a common horizontal line with the second spring beam 326 and the second damper mass 328. Thus, first and second damper masses 324, 328 may be disposed at a common height on opposite horizontal sides 344, 346.

Figure 7:
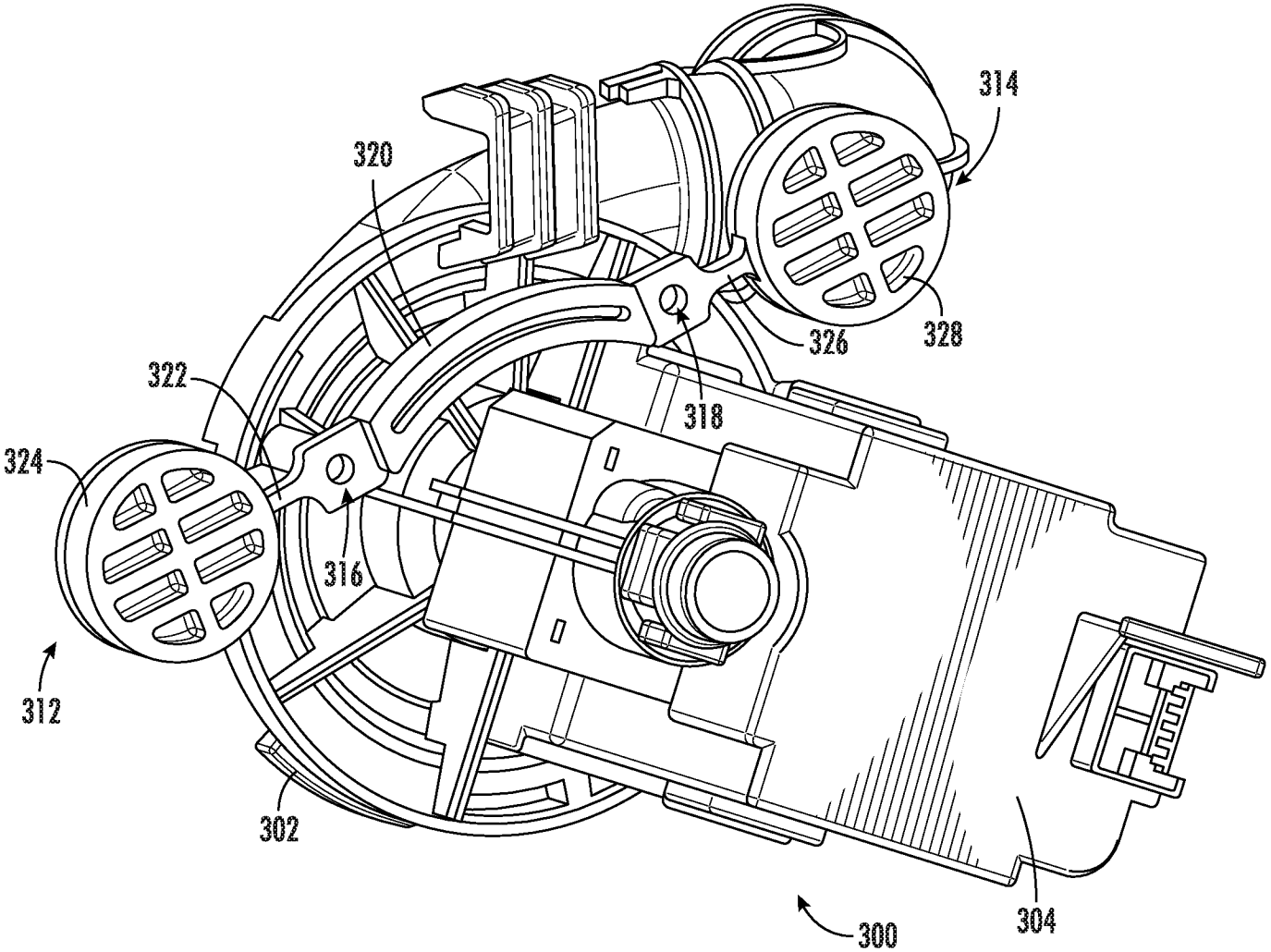
FIG. 7 provides a perspective view of a sump and pump assembly of a dishwashing appliance according to exemplary embodiments of the present disclosure.
Figure 8:
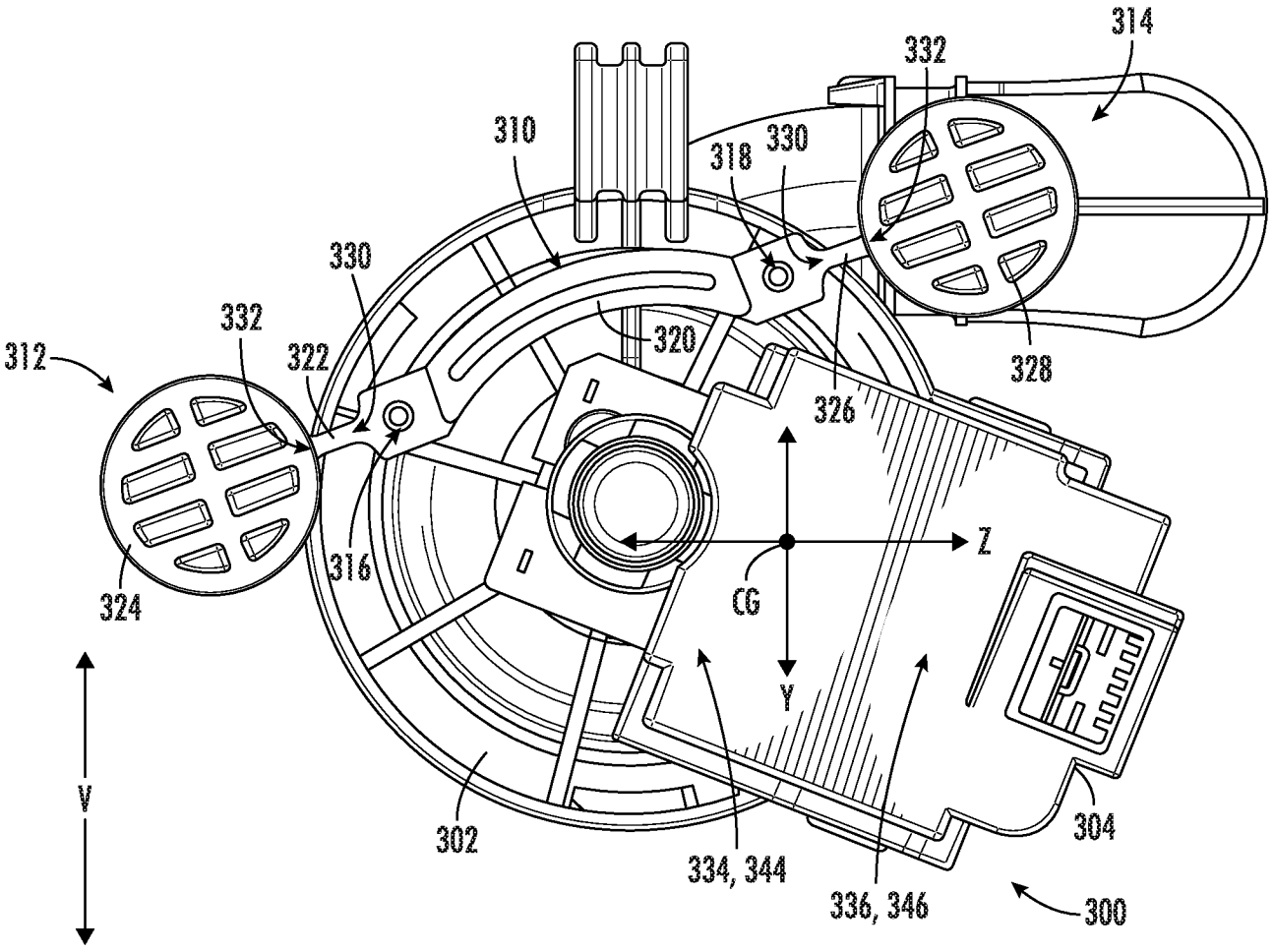
FIG. 8 provides an elevation view of the exemplary pump of FIG. 7.
Figure 9:
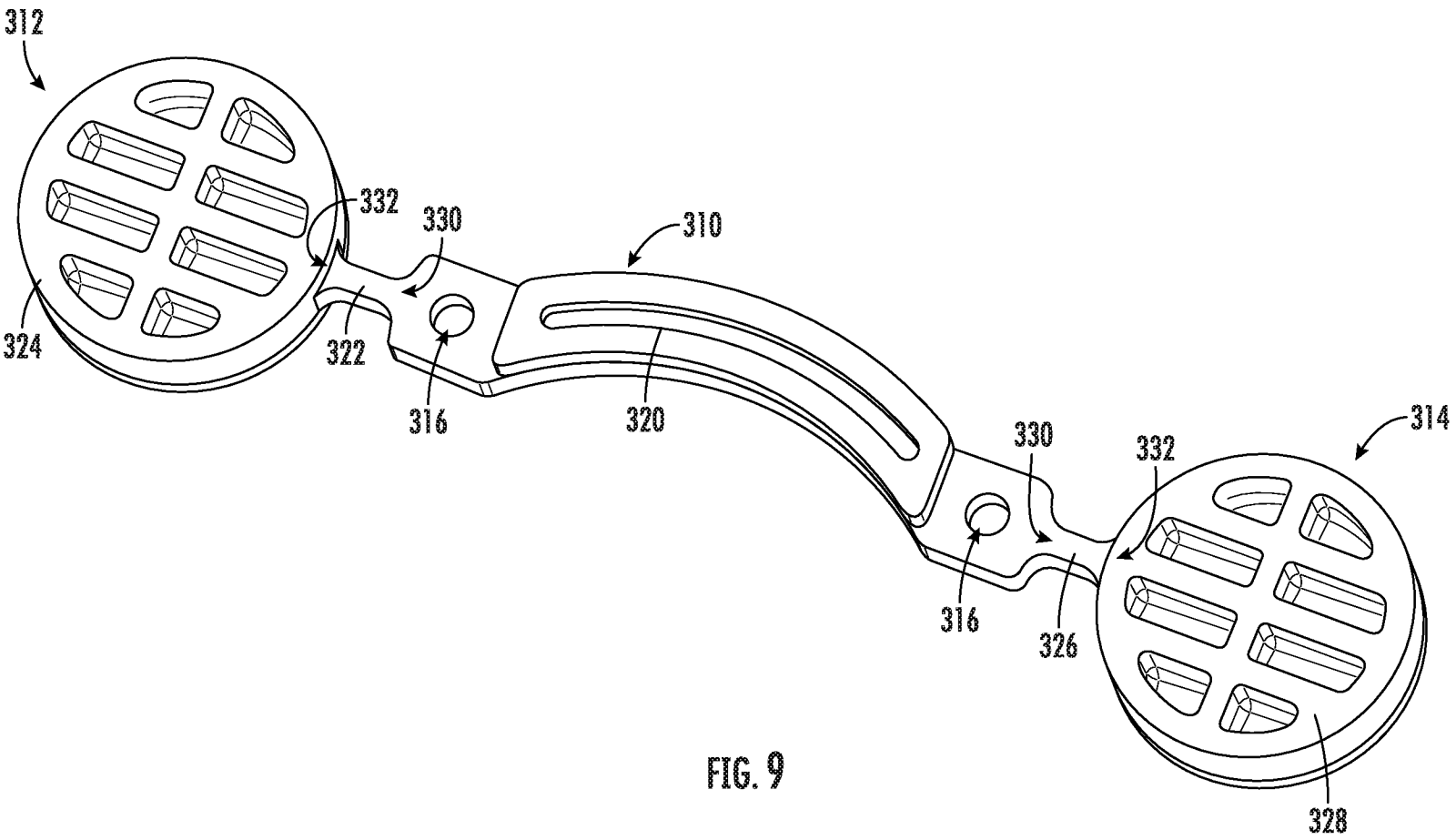
FIG. 9 provides a perspective view of the exemplary vibration damper of FIG. 7.

Turning now to FIGS. 7 through 9, various views are provided illustrating an exemplary vibration damper 310. Generally, vibration damper 310 may be attached to fluid pump 300 to absorb vibrations thereof (e.g., along or about the Y-axis, X-axis, or Z-axis). Specifically, vibration damper 310 includes a pair of tuned damper bodies 312, 314 (i.e., a first damper body 312 and second damper body 314) that can be fixed to pump housing 302 at one or more attachment points 316, 318 (e.g., via a suitable adhesive or mechanical fastener, such as a screw, bolt, clip, mated thread, rivet, etc.).

In some embodiments, such attachment points 316, 318 are generally defined by one or more mounting brackets 320. As an example, discrete mounting brackets 320 may be provided for (and correspond to) each discrete damper body 312, 314 (e.g., each mounting bracket 320 having one or more corresponding attachment points 316, 318). As another example, and as shown, a single mounting bracket 320 may be provided for both damper bodies 312, 314. In the illustrated embodiments, two discrete attachment points 316, 318 are defined at discrete longitudinal locations. Thus, the two discrete attachment points 316, 318 are longitudinally spaced apart (e.g., relative to the Z-axis). Optionally, one attachment point 318 may be vertically aligned with the center of gravity CG (e.g., the one attachment point 318 and the center of gravity CG may be located along the Y-axis of an X-Y plane). Additionally or alternatively, a separate attachment point 316 may be horizontally spaced apart from (e.g., offset) from the center of gravity CG. Further additionally or alternatively, the one attachment point 318 may be disposed at a height that is higher than the height of the separate attachment point 316. In certain embodiments, it is notable that only two attachment points 316, 318 are provided, thereby generally reducing assembly costs and difficulties. separate attachment point 316 may be horizontally spaced apart from (e.g., offset) from the center of gravity CG.

As shown, each damper body 312, 314 includes a corresponding spring beam 322, 326 and damper mass 324, 328 mounted on the spring beam 322, 326. Thus, first damper body 312 includes a first spring beam 322 and a first damper mass 324; second damper body 314 includes a second spring beam 326 and a second damper mass 328. Generally, and as will be described in greater detail below, each damper mass 324, 328 may be permitted to oscillate or move with respect to pump housing 302 as the pump motor 304 drives rotation and the corresponding spring beam 322, 326 deforms.

In the illustrated embodiments, first spring beam 322 extends longitudinally between a fixed end 330 and a free end 332. When assembled, the fixed end 330 of first spring beam 322 is generally close (i.e., proximal) to the pump housing 302. For instance, the fixed end 330 of first spring beam 322 may be joined (e.g., fixedly joined or, alternatively, separably joined) to mounting bracket 320. The fixed end 330 may thus be defined at or adjacent to (e.g., in comparison to the free end 332) mounting bracket 320 or a first attachment point 316. In some such embodiments, first spring beam 322 is integral to (e.g., formed as a monolithic unitary member with) mounting bracket 320. Nonetheless, alternative embodiments may provide a set of mated threads between first spring beam 322 and mounting bracket 320. Thus, first spring beam 322 may be threaded for mounting relative to mounting bracket 320.

In contrast to the fixed end 330, the free end 332 of first spring beam 322 is relatively far from (i.e., distal to) the pump housing 302. In certain embodiments, the free end 332 may be offset (e.g., spaced apart) from the center of gravity CG at a first radial side 334 thereof. Thus, the free end 332 of first spring beam 322 may held on one radial side 334 of the center of gravity CG. As an example, a vertical axis (e.g., Y-axis) extending from the center of gravity CG may separate two horizontal sides 344, 346 such that the free end 332 of first spring beam 322 is maintained on the first horizontal side 344. In some embodiments, the extension of first spring beam 322 (e.g., from the fixed end 330 to the free end 332) lies on path or axis that is perpendicular to the rotation axis A or X-axis. Optionally, the extension may be along a path that is non-orthogonal relative to the Z-axis (e.g., at a descending or negative angle relative to the Z-axis from the mounting bracket 320).

As shown, the first damper mass 324 is disposed on the free end 332 of first spring beam 322. Thus, first damper mass 324 may be held on the first radial side 334. In some embodiments, first damper mass 324 is stiffer than the first spring beam 322. Specifically, first damper mass 324 may define a higher stiffness value relative to the Y-axis, Z-axis, or X-axis (e.g., one or all of the three axes) than first spring beam 322. Elastic deformation of first damper body 312 (e.g., during activation of pump motor 304) may, in turn, be concentrated at first spring beam 322, which may act as a deformable cantilever. Optionally, first damper body 312 defines a larger cross-sectional area (e.g., perpendicular to a longitudinal direction) than first spring beam 322, as shown. In some such embodiments, first damper mass 324 is integral to (e.g., formed as a monolithic unitary member with) first spring beam 322. Nonetheless, alternative embodiments may provide a set of mated threads between first spring beam 322 and first damper mass 324. Thus, first damper mass 324 may be threaded for mounting relative to first spring beam 322. Moreover, although first damper mass 324 is illustrated as a rectangular prism, any suitable shape (e.g., cylinder, disk, etc.) may be provided, such as a shape that is longitudinally symmetrical.

In the illustrated embodiments, second spring beam 326 extends longitudinally between a fixed end 330 and a free end 332. When assembled, the fixed end 330 of second spring beam 326 is generally close (i.e., proximal) to the pump housing 302. For instance, the fixed end 330 of second spring beam 326 may be joined (e.g., fixedly joined or, alternatively, separably joined) to mounting bracket 320. The fixed end 330 may thus be defined at or adjacent to (e.g., in comparison to the free end 332) mounting bracket 320 or a second attachment point 318. In some such embodiments, second spring beam 326 is integral to (e.g., formed as a monolithic unitary member with) mounting bracket 320. Nonetheless, alternative embodiments may provide a set of mated threads between second spring beam 326 and mounting bracket 320. Thus, second spring beam 326 may be threaded for mounting relative to mounting bracket 320.

In contrast to the fixed end 330, the free end 332 of second spring beam 326 is relatively far from (i.e., distal to) the pump housing 302. In certain embodiments, the free end 332 may be offset (e.g., spaced apart) from the center of gravity CG at a second radial side 336 thereof. Thus, the free end 332 of second spring may held on one radial side 336 of the center of gravity CG. As an example, a vertical axis (e.g., Y-axis) extending from the center of gravity CG may separate two horizontal sides 344, 346 such that the free end 332 of second spring beam 326 is maintained on the second horizontal side 346. In some embodiments, the extension of second spring beam 326 (e.g., from the fixed end 330 to the free end 332) lies on path or axis that is perpendicular to the rotation axis A or X-axis. Optionally, the extension may be along a path that is non-orthogonal relative to the Z-axis (e.g., at an ascending or positive angle relative to the Z-axis from the mounting bracket 320).

As shown, the second damper mass 328 is disposed on the free end 332 of second spring beam 326. Thus, second damper mass 328 may be held on the second radial side 336. In some embodiments, second damper mass 328 is stiffer than the second spring beam 326. Specifically, second damper mass 328 may define a higher stiffness value relative to the Y-axis, Z-axis, or X-axis (e.g., one or all of the three axes) than second spring beam 326. Elastic deformation of second damper body 314 (e.g., during activation of pump motor 304) may, in turn, be concentrated at second spring beam 326, which may act as a deformable cantilever. Optionally, second damper body 314 defines a larger cross-sectional area (e.g., perpendicular to a longitudinal direction) than second spring beam 326, as shown. In some such embodiments, second damper mass 328 is integral to (e.g., formed as a monolithic unitary member with) second spring beam 326. Nonetheless, alternative embodiments may provide a set of mated threads between second spring beam 326 and second damper mass 328. Thus, second damper mass 328 may be threaded for mounting relative to second spring beam 326. Moreover, although second damper mass 328 is illustrated as a generally circular prism or disk, any suitable shape (e.g., cylinder, sphere, etc.) may be provided, such as a shape that is longitudinally symmetrical.

Relative to the fluid pump 300, the first and second damper bodies 312, 314 may be symmetrically tuned to notably counteract the translational or rotational forces generated during activation of pump motor 304 (e.g., to notably counteract motion coupling that might otherwise occur with a single damper body). For instance, first and second spring beams 322, 326, including the first and second spring beams 322, 326 and first and second damper masses 324, 328, may be symmetrically tuned at opposite sides of the center of gravity CG. Optionally, first and second damper bodies 312, 314 may be formed integrally (i.e., as an integral unitary member), such as with mounting bracket 320.

In the illustrated embodiments of FIGS. 7 through 9, the first spring beam 322 and first damper mass 324 as well as the second spring beam 326 and the second damper mass 328 extend perpendicular to the rotation axis A. Moreover, the first spring beam 322 and first damper mass 324 extend along a paths that are defined at a non-orthogonal angle relative to the Z-axis. Thus, first and second damper masses 324, 328 may be disposed at a discrete heights on opposite horizontal sides 344, 346.

Figure 10:
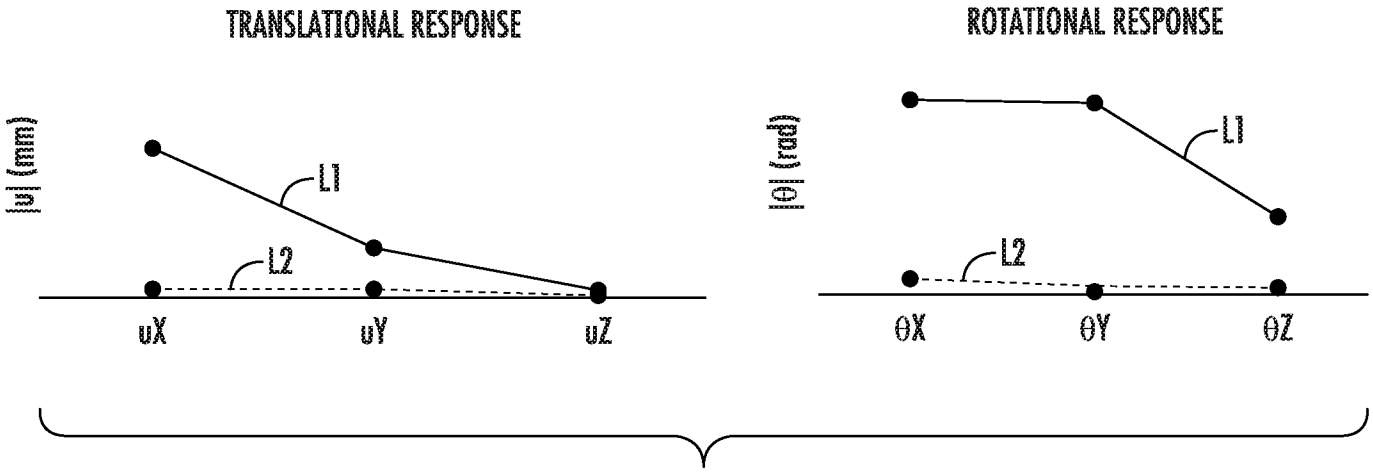
FIG. 10 provides a flow chart illustrating the relative impact of a vibration damper of translation and rotation of a fluid pump during activation thereof.

Advantageously, vibration damper 310, as described herein, may significantly reduce deflective translation (e.g., along or more of the X-axis, Z-axis, or Y-axis) or rotation (e.g., about or more of the X-axis, Z-axis, or Y-axis) of fluid pump 300. In particular, translation along the X-axis, as well as rotation about the X and Y axes may be significantly reduced, as illustrated in the chart of FIG. 10 showing the fluid pump 300 response during activation—both without an above-described vibration damper (L1) and with an above-described vibration damper (L2).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A pump assembly for a domestic appliance defining a vertical axis, the pump assembly comprising:

a fluid pump defining a center of gravity and mutually perpendicular X-, Y-, and Z-axes, wherein the Y-axis is a vertical axis extending along a vertical direction from the center of gravity, the fluid pump comprising:

a pump housing, and a motor mounted to the pump housing; and a vibration damper attached to the fluid pump to absorb vibrations thereof, the vibration damper comprising a first spring beam extending longitudinally along a longitudinal direction non-parallel to the Y-axis between a fixed end proximal to the pump housing and a free end distal to the pump housing, the free end of the first spring beam being offset from the center of gravity at a first radial side disposed on a first side of the center of gravity relative to the Y-axis, a first damper mass disposed on the free end of the first spring beam at the first radial side, a second spring beam extending longitudinally along the longitudinal direction non-parallel to the Y-axis between a fixed end proximal to the pump housing and a free end distal to the pump housing, the free end of the second spring beam being offset from the center of gravity at a second radial side disposed on a second side of the center of gravity relative to the Y-axis, a second damper mass disposed on the free end of the second spring beam at the second radial side, and a mounting bracket joining the first spring beam and the second spring beam, the mounting bracket defining a plurality of discrete attachment points, the plurality of discrete attachment points each comprising one or more mechanical fasteners attached to the pump housing and horizontally spaced apart from each other, at least one attachment point of the plurality of discrete attachment points being aligned with and above the center of gravity along the Y-axis.

2. The pump assembly of claim 1, wherein the mounting bracket is joined to the first spring beam at the fixed end thereof, and wherein the mounting bracket is joined to the second spring beam at the fixed end thereof.

3. The pump assembly of claim 1, wherein the fluid pump comprises a displacement body and defines a rotation axis about which the displacement body rotates, and wherein the first spring beam and the second spring beam extend perpendicularly relative to the rotation axis.

4. The pump assembly of claim 1, wherein the first and second radial sides are disposed at opposite horizontal sides, the opposite horizontal sides being opposite sides relative to the Y-axis.

5. The pump assembly of claim 1, wherein the first spring beam and the first damper mass extend along a common longitudinal line with the second spring beam and the second damper mass, the common longitudinal line being perpendicular to the Y-axis.

6. The pump assembly of claim 1, wherein the first damper mass and the second damper mass are held at different vertical heights relative to the Y-axis.

7. The pump assembly of claim 1, wherein the first spring beam and the first damper mass are symmetrically tuned with the second spring beam and the second damper mass at opposite sides of the center of gravity to have equivalent natural frequencies or vibrational modes to cancel or counteract displacement at a pair of the first spring beam and the first mass damper with displacement at a pair of the second spring beam and the second mass damper.

8. The pump assembly of claim 1, wherein the vibration damper is an integral unitary member.

9. The pump assembly of claim 1, wherein the motor is a synchronous motor.

10. A dishwashing appliance defining a vertical direction, the dishwashing appliance comprising:

a tub that defines a wash chamber for receipt of articles for washing;

a sump positioned at a bottom portion of the tub along the vertical direction;

a pump comprising a pump housing mounted to the sump, the pump housing defining mutually perpendicular X-, Y-, and Z-axes, a center of gravity of the pump defined within the pump, wherein the Y-axis is a vertical axis extending along the vertical direction from the center of gravity;

a motor mounted to the pump housing below the sump; and a vibration damper attached to the pump housing to absorb vibrations thereon, the vibration damper comprising a first spring beam extending longitudinally along a longitudinal direction non-parallel to the Y-axis between a fixed end proximal to the pump housing and a free end distal to the pump housing, the free end of the first spring beam being offset from the center of gravity at a first radial side disposed on a first side of the center of gravity relative to the Y-axis, a first damper mass disposed on the free end of the first spring beam at the first radial side, a second spring beam extending longitudinally along the longitudinal direction non-parallel to the Y-axis between a fixed end proximal to the pump housing and a free end distal to the pump housing, the free end of the second spring beam being offset from the center of gravity at a second radial side, and a second damper mass disposed on the free end of the second spring beam at the second radial side disposed on a second side of the center of gravity relative to the Y-axis, and a mounting bracket joining the first spring beam and the second spring beam, the mounting bracket defining a plurality of discrete attachment points attached to the pump housing, the discrete attachment points each comprising one or more mechanical fasteners, at least one attachment point of the plurality of discrete attachment points being aligned with and above the center of gravity along the Y-axis, a separate attachment point of the plurality of discrete attachment points being horizontally offset from the center of gravity and lower than the at least one attachment point such that the separate attachment point is discontinuous from the at least one attachment point.

11. The dishwashing appliance of claim 10, wherein the mounting bracket is joined to the first spring beam at the fixed end thereof, and wherein the mounting bracket is joined to the second spring beam at the fixed end thereof.

12. The dishwashing appliance of claim 10, wherein the pump assembly comprises a displacement body and defines a rotation axis about which the displacement body rotates, and wherein the first spring beam and the second spring beam extend perpendicularly relative to the rotation axis.

13. The dishwashing appliance of claim 10, wherein the first and second radial sides are disposed at opposite horizontal sides, the opposite horizontal sides being opposite sides relative to the Y-axis.

14. The dishwashing appliance of claim 10, wherein the first spring beam and the first damper mass extend along a common horizontal line with the second spring beam and the second damper mass, the common horizontal line being perpendicular to the vertical direction.

15. The dishwashing appliance of claim 10, wherein the first damper mass and the second damper mass are held at discrete vertical heights relative to the vertical direction.

16. The dishwashing appliance of claim 10, wherein the first spring beam and the first damper mass are symmetrically tuned with the second spring beam and the second damper mass at opposite sides of the center of gravity to have equivalent natural frequencies or vibrational modes to cancel or counteract displacement at a pair of the first spring beam and the first mass damper with displacement at a pair of the second spring beam and the second mass damper.

17. The dishwashing appliance of claim 10, wherein the vibration damper is an integral unitary member.

18. The dishwashing appliance of claim 10, wherein the motor is a synchronous motor.

19. A dishwashing appliance defining a vertical direction, the dishwashing appliance comprising:

a tub that defines a wash chamber for receipt of articles for washing;

a sump positioned at a bottom portion of the tub along the vertical direction;

a fluid pump defining a center of gravity and mutually perpendicular X-, Y-, and Z axes, wherein the Y-axis is a vertical axis extending along the vertical direction from the center of gravity, the fluid pump comprising:

a pump housing, a motor mounted to the pump housing, and a displacement body mechanically coupled to the motor to rotate about a rotation axis; and a vibration damper attached to the pump housing to absorb vibrations thereon, the vibration damper comprising a first spring beam extending longitudinally along a longitudinal direction between a fixed end proximal to the pump housing and a free end distal to the pump housing, the free end of the first spring beam being offset from the center of gravity at a first radial side disposed on a first side of the center of gravity relative to the Y-axis, a first damper mass disposed on the free end of the first spring beam at the first radial side, a second spring beam extending longitudinally along the longitudinal direction between a fixed end proximal to the pump housing and a free end distal to the pump housing, the free end of the second spring beam being offset from the center of gravity at a second radial side, and a second damper mass disposed on the free end of the second spring beam at the second radial side disposed on a second side of the center of gravity relative to the Y-axis, and a mounting bracket joining the first spring beam and the second spring beam, the mounting bracket defining a plurality of discrete attachment points attached to the pump housing, the discrete attachment points each comprising one or more mechanical fasteners, at least one attachment point of the plurality of discrete attachment points being aligned with and above the center of gravity along the Y-axis, a separate attachment point of the plurality of discrete attachment points being horizontally offset from the center of gravity and lower than the at least one attachment point such that the separate attachment point is discontinuous from the at least one attachment point, wherein the first spring beam and the first damper mass are symmetrically tuned with the second spring beam and the second damper mass at opposite horizontal sides of the center of gravity to have equivalent natural frequencies or vibrational modes to cancel or counteract displacement at a pair of the first spring beam and the first mass damper with displacement at a pair of the second spring beam and the second mass damper, the opposite horizontal sides being opposite sides relative to the Y-axis, and wherein the longitudinal direction is perpendicular relative to the rotation axis and non-parallel to the Y-axis.

* * * * *